United States Patent [19]

Kwong et al.

[11] 4,252,745

[45] Feb. 24, 1981

[54] POLYMERIC REACTION PRODUCTS OF ALKOXYALKYLAMINES AND EPIHALOHYDRINS

[75] Inventors: Gary Kwong, Palatine, Ill.; Joseph Levy, Deerfield Beach, Fla.

[73] Assignee: UOP Inc., Des Plaines, Ill.

[21] Appl. No.: 92,384

[22] Filed: Nov. 8, 1979

[51] Int. Cl.[3] ..... C07C 89/02

[52] U.S. Cl. ..... 564/505; 44/63; 44/72; 252/51.5 R; 252/403; 564/487; 564/504

[58] Field of Search ..... 260/584 B, 584 C, 584 R

[56] References Cited

U.S. PATENT DOCUMENTS

| | | | |
|---|---|---|---|
| 3,424,681 | 1/1969 | Stanford | 260/584 B X |
| 3,499,930 | 3/1970 | Wakeman et al. | 260/584 C |
| 3,567,659 | 3/1971 | Nagy | 260/584 B X |
| 3,636,114 | 1/1972 | Tobler et al. | 260/584 B X |
| 3,855,158 | 12/1974 | Petrovich et al. | 260/584 B X |
| 3,855,299 | 12/1974 | Witt | 260/584 R |
| 4,140,798 | 2/1979 | Merianos et al. | 260/584 B X |
| 4,178,434 | 12/1979 | Langdon | 260/584 B X |

*Primary Examiner*—John Doll

*Attorney, Agent, or Firm*—James R. Hoatson, Jr.; Raymond H. Nelson; William H. Page, II

[57] ABSTRACT

Novel compositions comprise the polymeric reaction products of primary alkoxyalkylamines with epihalohydrins at temperatures in the range from about 40° C. to about 150° C. in the presence of an inorganic base. Such reaction products may be used as sedimentation and degradation inhibitors in hydrocarbon oils, antifoulants, carburetor detergents, lubricant additives, and corrosion inhibitors.

10 Claims, No Drawings

POLYMERIC REACTION PRODUCTS OF ALKOXYALKYLAMINES AND EPIHALOHYDRINS

BACKGROUND OF THE INVENTION

Various types of petroleum-derived hydrocarbon oils undergo deterioration on storage or upon exposure to severe conditions. Thus fuel oils such as gasoline, diesel fuel, jet fuel, other aviation fuel, burner oil, furnace oil, kerosene, and naphtha, for example, and other oils such as lubricating oils, cutting oils, slushing oils, etc., undergo deterioration as evidenced by such changes as, for example, formation of sediment and discoloration.

Sediment formation is undesirable for various reasons. The settling of accumulated particulates in tanks storing hydrocarbon oils requires periodic draining and cleaning of storage tanks, leading to temporary unavailability of storage capacity, substantial diversion of manpower, and waste disposal problems. Sediment formation in burner oil tends to plug strainers, burner tips, injectors, etc. In diesel fuel such sediment tends to form sludge and varnish in the engine. If the oil is used as a heat exchange medium, as for example with jet fuel, the sediment tends to plug exchanger coils. In gasoline the sediment may tend to deposit on sensitive parts in an internal combustion engine, such as carburetors, thereby decreasing the efficiency of combustion and causing increased fuel consumption.

It is apparent, therefore, that reduced sediment formation in hydrocarbon oils is desirable. One method of effecting such reduction would be to eliminate, to a substantial degree, those processes leading to particulate formation, such as oxidation. Another method would be to prevent agglomeration and/or settling of the formed particulate matter by effectively maintaining the fine particulates in a well dispersed state, for when the particulates are so dispersed the aforementioned difficulties associated with sediment formation either do not occur or are of substantially lessened severity.

Discoloration of hydrocarbon oils is undersirable because it is an indication that degradation has occurred or is occurring, hence there is a marked customer preference for lighter oils. Thus there is an economic incentive for minimizing discoloration and degradation of hydrocarbon oils, especially during long-term storage.

SUMMARY OF THE INVENTION

This invention relates to a novel reaction product and a method of preparation thereof. One embodiment comprises the polymeric reaction product of 1 molar proportion of an alkoxyalkylamine, wherein the alkoxy group contains from about 1 to about 25 carbon atoms, the alkyl group is an alkylene group containing from 2 to about 10 carbon atoms, and the amine is a primary amine which may contain multiple alkylene amino units, with from about 0.5 to about 2.0 molar proportions of an epihalohydrin, at a temperature from about 40° C. to about 150° C. in the presence of an inorganic base. A more specific embodiment comprises said polymeric reaction product wherein said epihalohydrin is epichlorohydrin. A still more specific embodiment comprises said polymeric reaction product wherein said alkoxy group contains from about 6 to about 20 carbon atoms, said alkyl group is a propylene group, said amine moiety is $—NH_2$ or $—NH(CH_2)_3NH_2$, and said epihalohydrin is epichlorohydrin.

DESCRIPTION OF THE INVENTION

The novel compositions of matter of this invention are polymeric reaction products of an alkoxyalkylamine with an epihalohydrin formed at a reaction temperature from about 40° C. to about 150° C. in the presence of an inorganic base. Such reaction products have a board range of uses, as is described within. Additionally, such reaction products generally have relatively low pour points and viscosities. Such attributes are desirable in ease of handling and utilizing these materials in their perceived uses. For example, additives for hydrocarbon oils frequently are metered into the oil by pumping under a wide range of temperatures, and it is desirable that such additives remain liquid and pourable, with not too high a viscosity at low temperatures, to ensure pumpability.

As mentioned previously, the materials of this invention are polymeric reaction products of an alkoxyalkylamine with an epihalohydrin under the aforementioned reaction conditions. The reaction frequently is conducted in a high-boiling, unreactive solvent to moderate the exothermic reaction and for ease of manipulation, both during the reaction and afterwards. However, the use of a solvent, where such use is undesirable, may be eliminated although the results may not be necessarily equivalent. Among the solvents which may be used are included toluene, xylene, mesitylene, ethylbenzene, propylbenzene, and other alkylated and polyalkylated aromatics as examples of suitable high-boiling but unreactive materials.

The term "alkoxyalkylamines" as set forth in the specification and appended claims will include primary amines and will include monoamines, diamines, triamines, etc. Where monoamines are used the amine can be represented as $ROR_1NH_2$. The alkoxy group, RO, of such monoamines contains from about 1 to about 25 carbon atoms, but preferably from about 6 to about 20 carbon atoms. Suitable groups representative of the carbonaceous portion of the alkoxy group include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl moieties. Such groups commonly have their commercial origin in fatty acids and petroleum-derived alcohols, and consequently are often supplied as mixtures. Therefore it is to be understood that amines containing a combination of the aforementioned groups are explicitly within the scope of this invention.

When the carbonaceous portion of the alkoxy group is derived from fatty acids the major portion is an unbranched aliphatic group. When the carbonaceous portion comes from petroleum-derived olefins, the major portion generally is a branched aliphatic group. In each case minor amounts of unsaturated material may be present. Therefore it is to be understood explicitly that the carbonaceous portion of the alkoxy group of the alkoxyalkylamines of this invention may be comprised of either a major portion of unbranched or branched aliphatic groups which may contain minor amounts of unsaturation.

The alkyl group, $R_1$, of the alkoxyalkylamines of this invention is an alkylene group containing from 2 to about 10 carbon atoms. Examples of alkylene groups which are suitable include ethylene, propylene, butylene, amylene, hexylene, heptylene, octylene, nonylene, and decylene. In a preferred embodiment the alkylene group is propylene. Such alkylene groups generally are unsubstituted, but branched alkylene groups may be employed, not necessarily with equivalent results. Examples of the latter include isopropylene, sec-butylene, iso-butylene, sec-amylene, iso-amylene, etc.

It is a discovery of this invention that diamines, triamines, tetramines, etc., also form polymeric reaction products of this invention. In the case of diamines the structure may be represented as $R—O—R_1NHR_2NH_2$, where RO and $R_1$ bear the same description as that set forth above for the monoamines. The group $R_2$ is, like $R_1$, an alkylene group containing from 2 to about 10 carbon atoms, generally unbranched but not necessarily so. $R_1$ and $R_2$ may be the same or may be different. Examples of diamines, cited solely for illustrative purposes, include alkoxyalkyl ethylenediamine, alkoxyalkyl propylenediamine, alkoxyalkyl butylenediamine, alkoxyalkyl amylenediamine, alkoxyalkyl hexylenediamine, etc., alkoxyalkyl isopropylenediamine, alkoxyalkyl isobutylenediamine, alkoxyalkyl sec-butylenediamine, and so forth. In a preferred embodiment both $R_1$ and $R_2$ are propylene groups, $—CH_2CH_2CH_2—$.

In a like manner the triamines can be represented as $ROR_1NHR_2NHR_3NH_2$, the tetramines as $ROR_1NHR_2NHR_3NHR_4NH_2$, the pentamines as $ROR_1NHR_2NHR_3NHR_4NHR_5NH_2$, etc., with a general formula of $ROR_1(NHR_2)_mNH_2$, where m is the number of amino groups present in the polyamine and is an integer less than about 10. The description of RO and $R_1$ in such polyamines conforms to that given hereinbefore. In the embodiment where m is equal to or greater than 2, the group $R_2$ is an alkylene group otherwise conforming to the description hereinbefore set forth for $R_1$. Examples of such amines include alkoxyalkyl diethylenetriamine, alkoxyalkyl triethylenetetramine, alkoxyalkyl polyethyleneimine, alkoxyalkyl dipropylenetriamine, etc.

Just as the alkoxy group may contain a combination of carbonaceous groupings, so may the diamines, triamines, etc. contain a combination of polyamines. Therefore it is to be understood that this invention encompasses all mixtures of amines whose major components conform to those descriptions set forth above.

The amine or mixture of amines is reacted with an epihalohydrin. Epichlorohydrin is preferred, although epibromohydrin and epiiodohydrin may be used but not necessarily with equivalent results in every case. Other epihalohydrins which may be employed in this invention include 1-chloro-3,4-epoxybutane, 1-chloro-2,3-epoxybutane, 1-chloro-4,5-epoxypentane, 1-chloro-3,4-epoxypentane, etc., and the corresponding bromo and iodo compounds. Suitable condensation products may also be obtained when using a mixture of epihalohydrins, where each of the components meets the qualifications set forth above. The amount of epihalohydrin used ranges from about 0.5 to about 2 moles per mole of amine. Preferably the molar ratio of epihalohydrin to alkoxyalkylamine is in the range from about 0.7 to about 1.2.

The preparation of the reaction products of this invention is effected by contacting the epihalohydrin and amine, generally in a high boiling aromatic solvent, at a suitable temperature, and removing the inorganic halide which forms with an inorganic base. Generally the reaction may be conducted at a temperature from about 40° C. to about 150° C., a preferred temperature range being from about 60° C. to about 125° C. Inorganic bases suitable for use in the present invention include the alkali metal hydroxides and carbonates, and the alkaline earth oxides, hydroxides, and carbonates. Examples of such materials, cited for illustrative purposes only, are the hydroxides and carbonates of lithium, sodium, potassium, rubidium and cesium, magnesium oxide, magnesium hydroxide, magnesium carbonate, calcium oxide, calcium hydroxide, calcium carbonate, barium oxide, barium hydroxide, and barium carbonate. Where the epihalohydrin is used in up to equal molar proportions of the amine, then the molar amount of base employed is approximately equal to that of the amine, although an excess of base over amine up to about 50% often may be employed advantageously. Where the epihalohydrin is used in greater than molar proportions relative to amine, then the molar amount of base is about equal to that of epihalohydrin although an excess up to about 50% may be used.

The mode of preparation of the condensation products of this invention is susceptible to numerous variations on the theme of directly reacting the amine with the epihalohydrin under reaction conditions. An example of one general mode is the addition of epihalohydrin to a solution of the amine in a suitable solvent, generally a high-boiling aromatic compound or mixtures thereof. Reaction between the components occurs to a given acidity, or given amount of amine hydrohalide formation, at which time either aqueous or solid inorganic base is added to remove the halide thus formed. The primary reaction product therefrom undergoes further condensation leading to the ultimate reaction product.

An example of another mode of preparation is the concurrent addition of epihalohydrin and amine to the solvent employed at a suitable temperature. When reaction has occurred to a desired amount of acidity, aqueous or solid inorganic base is added and the liberated primary reaction product thereupon undergoes further condensation leading to the ultimate reaction product.

In still another method of preparation, the epihalohydrin and amine are added concurrently to the solvent containing a portion of the inorganic base employed. The base may be either in solution or as a solid. After reaction has occurred to a given amount of acidity the remaining portion of solid or aqueous base is added and the primary reaction product thereupon undergoes further condensation leading to the ultimate reaction product.

The chemical structures of the polymeric reaction products of this reaction are unknown. Based upon the chemical properties of the reactants, one can surmise that, using a monoamine and epichlorohydrin as an example of reactants, a likely primary reaction product is the hydrochloride salt of the structure.

$$ROR_1NHCH_2—\overset{\overset{\displaystyle OH}{|}}{CH}—CH_2NHR_1OR.$$

Upon addition of base, the hydrochloride salts are converted to the free base which can react with additional epichlorohydrin to give materials with the structure.

$$ROR_1NH(—CH_2\overset{\overset{\displaystyle OH}{|}}{C}HCH_2CHCH_2\overset{\overset{\displaystyle R_1OR}{|}}{N}—)_xCH_2\overset{\overset{\displaystyle OH}{|}}{C}HCH_2NHR_1OR$$

In addition, especially when diamines and other polyamines are used, cyclization and crosslinking may occur to a substantial degree.

The materials of this invention have been shown to be good dispersants of particulates while being poor dispersants of water. The combination of properties is an excellent one for use of these materials as sedimentation inhibitors of hydrocarbon oils, especially fuel oils. Additionally, the materials described herein show substantial inhibition of discoloration in hydrocarbon oils. Thus these materials are superior additives for preserving quality of hydrocarbon oils upon storage, especially at elevated temperatures or for relatively long periods of time. The polymeric reaction products of this invention may also be anticipated to have significant potential as corrosion inhibitors, carburetor detergents, antifoulants, lubricant additives, etc.

The following examples are merely illustrative of this invention, and it is to be understood that the invention is not necessarily limited thereby.

EXAMPLE 1

Epichlorohydrin (83.2 g, 0.90 mol) was added dropwise over about 50 minutes to a stirred, pale yellow-solution, initially at about 90° C., of tridecyloxypropylamine (280.4 g, 1.05 mole), dissolved in 222 g of Espesol 3BC. The latter is the trade name for high boiling bottoms from xylene fractionation as supplied by Charter Oil Co. The solution was stirred about 1.5 hours at 94°-110° C., after which a solution of 20% aqueous sodium hydroxide containing 0.99 mol of base was added over about 40 minutes while the reaction temperature was maintained at 86°-94° C. The mixture was stirred about 2.5 hours at 86°-91° C., and an additional 0.09 mole of base in water was added. The mixture was cooled, layers were separated, and the organic phase was filtered to give a clear, amber solution (544 g) which contained 53.2% active ingredient by the nitrogen jet gum method, ANSI/ASTM D 381-70 modified in that nitrogen is used as the gas.

EXAMPLE 2

Epichlorohydrin (0.240 mol) was added over 50 minutes to a pale yellow solution of N-tridecyloxypropyl-1,3-propylenediamine (0.26 mol) in 60 g of the aforementioned solvent at 76°-80° C. The mixture was stirred at 77°-83° C. for about 30 minutes, and 0.26 mol of a 20% aqueous sodium hydroxide solution was added over 15 minutes. Stirring at 78°-83° C. was continued about 1.8 hours, an additional 0.024 mole of base was added, and the mixture was stirred an additional 0.5 hr. at 82°-83° C. Finally layers were separated, 10 g xylene was added to the organic phase, and water was removed by aeotropic distillation to give 152 g (96%) of a clear yellow solution containing 54% of active ingredient.

EXAMPLE 3

Tridecyloxypropylamine (0.750 mol) and epichlorohydrin (0.712 mol) were added separately but concurrently to a stirred mixture of Espesol 3BC (160 g.) and 22% aqueous sodium hydroxide containing 0.0712 mol base at 73°-83° C. over a period of 1.5 hr. After an additional 10 min. 80° C. 22% aqueous sodium hydroxide containing 0.712 mol of base was added over 13 min. The mixture was stirred at 78°-87° C. for 1 hour, then at 110 C. for 2 hr. Layers were separated and the organic phase was filtered to give 387 g. (97%) of a solution containing 53.4% of active ingredient.

EXAMPLE 4

N-Tridecyloxypropyl-1,3-propylenediamine (0.740 mol) and epichlorohydrin (0.70 mols) were added concurrently over about 40 minutes to a mixture of Espesol 3BC (172 g) and 22% aqueous sodium hydroxide containing 0.070 mole of base at 75°-90° C. After 8 minutes additional 22% aqueous sodium hydroxide (0.70 mole of base) was added over 15 min. The temperature was increased to 110° C. over 1 hour and the mixture was stirred for 2 additional hours at that temperature. Layers were separated, 15 g of xylene was added to the organic phase, and water was removed by aeotropic distillation to give 423 g (97%) of a light amber solution containing 53% of active ingredient.

EXAMPLE 5

An alkoxypropyl-1,3-propylenediamine mixture rich in $C_{12}$-$C_{15}$ groupings (0.594 mol) and epichlorohydrin (0.56 mol) was added concurrently over a period of 1 hour to a mixture of 137 g. Espesol 3BC and 22% aqueous sodium hydroxide (0.056 mol) at 71°-91° C. After 5 minutes, 0.56 mol of additional base, as a 22% aqueous solution was added with stirring at 83°-92° C. over 13 min. The temperature was raised to 108° C. and the mixture was stirred at 106°-9° C. for about 3¼ hour. Layers were separated, 15 g xylene was added to the organic phase and water was removed by azeotropic distillation to give 361 g. (96%) of a clear yellow solution containing 54.3% active ingredient.

EXAMPLE 6

The polymeric reaction products of this invention generally have relatively low pour points and viscosities. These properties are desirable to ensure ease of manipulation even at the low temperatures where such materials can be anticipated to be used. In Table 1 are collected several representative reaction products from epichlorohydrin whose pour points and viscosity were determined as a 50% solution in Espesol 3BC. For comparison a commercially successful additive, sold under the trade name of PolyFlo 130 by UOP Inc., and here designated as PF130, used to inhibit sedimentation and discoloration is included. The pour point was determined by the method of ANSI/ASTM D97-66; viscosity was determined using the methods ANSI/ASTM D445-74 and D2161-74.

TABLE 1

| | Pour Points and Kinematic Viscosities of 50 Weight % Solutions | | |
|---|---|---|---|
| Amine | Ratio Epichlorohydrin/ Amine | Pour Point (°F.) | Viscosity (Saybolt Universal Second) |
| PF130 | | +10 | 204 |
| $C_{8-10}OC_3NH_2$ | 19/20 | <−40 | 79.4 |
| $C_{13}OC_3NH_2$ | 6/7 | <−40 | 62.3 |
| $C_{10}OC_3NHC_3NH_2$ | 9/11 | 0 | 78.9 |
| $C_{13}OC_3NHC_3NH_2$ | 12/13 | <−40 | 53.2 |

The data of Table 1 show dramatic improvement by the materials of this invention relative to a product which can be taken as an industry standard. Most materials show a pour point less than −40° F., with a viscosity one-half to one-fourth of the standard.

EXAMPLE 7

The dispersing tendency of the polymeric reaction products of this invention was determined using the method of ANSI/ASTM D1094-72. In this method the condition of the interface and the degree of separation between a phosphate buffer and a hydrocarbon was determined after being shaken for 2 minutes. The condition of the interface is rated from 1 (best) to 4 (worst), and the separation from 1 (best) to 3 (worst). On these tests isooctane was used as the hydrocarbon containing about 30 ppm of reaction products. The first entry is the commercial product described in the prior example. In all cases the reaction product resulted from the use of epichlorohydrin.

TABLE 2

| | Shake Test With Isooctane | | | |
|---|---|---|---|---|
| Amine | Epichlorohydrin/ Amine | Conc. (ppm) | Interface | Separation |
| PF130 | | 12 | 4 | 3 |
| $C_{8-10}OC_3NH_2$ | 19/20 | 30 | 1 | 1 |
| $C_6OC_3NH_2$ | 19/20 | 34 | 1 | 1 |
| $C_{13}OC_3NH_2$ | 6/7 | 34 | 1 | 1 |
| $C_{10}OC_3NHC_3NH_2$ | 12/13 | 34 | 4 | 1 |
| $C_{13}OC_3NHC_3NH_2$ | 12/13 | 29 | 1–2 | 1 |

These data show that most of the polymeric reaction products of this invention show relatively little dispersability toward water. Phase separation is clean, as evidenced by the condition of the interface, and emulsifying properties are quite low as evidenced by the separation. There is marked improvement over the standard, which shows the products of this invention have a quite desirable selectivity as regards dispersability.

We claim as our invention:

1. The polymeric reaction product formed by reacting one molar proportion of an alkoxyalkylamine with about 0.5 to about 2.0 molar proportions of an epihalohydrin selected from the group consisting of epihalohydrin, 1-halo-3,4-epoxybutane, 1-halo-2,3-epoxybutane, 1-halo-4,5-epoxypentane, and 1-halo-3,4-epoxypentane, at a temperature from about 40° C. to about 150° C. in the presence of an inorganic base.

2. The polymeric reaction product of claim 1 where the alkoxy moiety of said alkoxyalkylamine is selected from the group consisting of aliphatic moieties containing from about 1 to about 25 carbon atoms, the alkyl moiety of said alkoxyalkylamine is an alkylene moiety containing from 2 to about 10 carbon atoms, and the amine is a primary amine selected from the group consisting of amino and $(HNR_2)mNH_2$ where m is an integer from 1 to about 10 and $R_2$ is an alkylene moiety containing from 2 to about 10 carbon atoms.

3. The polymeric reaction product of claim 2 wherein said epihalohydrin is epichlorohydrin.

4. The polymeric reaction product of claim 3 wherein said alkoxy moiety is selected from the group consisting of aliphatic moieties containing from about 6 to about 20 carbon atoms.

5. The polymeric reaction product of claim 3 wherein said alkoxyalkylamine is an alkoxypropylamine.

6. The polymeric reaction product of claim 3 wherein said alkoxyalkylamine is an alkoxypropyl propylenediamine.

7. The polymeric reaction product of claim 3 wherein said molar proportions of epichlorohydrin is from about 0.7 to about 1.2.

8. The polymeric reaction product of claim 3 wherein the reaction product is formed at a temperature from about 60° C. to about 120° C.

9. The polymeric reaction product of claim 5 wherein said alkoxypropylamine is tridecyloxypropylamine.

10. The polymeric reaction product of claim 6 wherein said alkoxypropyl propylenediamine is N-tridecyloxypropyl-1,3-propylenediamine.

* * * * *